US009982688B2

(12) United States Patent
Wang et al.

(10) Patent No.: US 9,982,688 B2
(45) Date of Patent: May 29, 2018

(54) MOUNTING ARRANGEMENT FOR VARIABLE STATOR VANE

(71) Applicant: ROLLS-ROYCE PLC, London (GB)

(72) Inventors: Ning Wang, Stuttgart (DE); Ewan F Thompson, Derby (GB)

(73) Assignee: ROLLS-ROYCE plc, London (GB)

( * ) Notice: Subject to any disclaimer, the term of this patent is extended or adjusted under 35 U.S.C. 154(b) by 252 days.

(21) Appl. No.: 14/876,113

(22) Filed: Oct. 6, 2015

(65) Prior Publication Data

US 2016/0108931 A1 Apr. 21, 2016

(30) Foreign Application Priority Data

Oct. 16, 2014 (GB) ..... 1418321.4

(51) Int. Cl.
*F01D 9/04* (2006.01)
*F04D 29/64* (2006.01)
(Continued)

(52) U.S. Cl.
CPC ..... *F04D 29/644* (2013.01); *F01D 9/042* (2013.01); *F01D 17/162* (2013.01); *F04D 19/002* (2013.01); *F04D 27/002* (2013.01); *F04D 29/542* (2013.01); *F04D 29/563* (2013.01); *F05D 2250/13* (2013.01); *F05D 2300/43* (2013.01)

(58) Field of Classification Search
CPC ..... F01D 9/042; F01D 17/162; F04D 27/002; F04D 27/0246; F04D 29/563; F05D 2250/90
See application file for complete search history.

(56) References Cited

U.S. PATENT DOCUMENTS 4,395,195 A 7/1983 De Cosmo et al.
4,706,354 A * 11/1987 Naudet ..... F01D 17/162 29/428
(Continued)

FOREIGN PATENT DOCUMENTS

EP 1705341 A2 9/2006

OTHER PUBLICATIONS

Mar. 18, 2015 Search Report issued in British Patent Application No. 1418321.4.
(Continued)

*Primary Examiner* — Ninh H Nguyen
(74) *Attorney, Agent, or Firm* — Oliff PLC

(57) ABSTRACT

The present invention provides a mounting arrangement for mounting a variable stator vane within a gas turbine engine. The mounting arrangement comprises an inner shroud having a radially- and circumferentially-extending slot and at least one insert which, in use, is retained within said slot. The or each insert has at least one bore for receiving a spindle portion of the variable stator vane. The at least one insert is formed of a plastics material and/or the slot and the at least one insert each have a respective axial cross section with a respective first width (axial dimension) which is greater than and radially inwards from a respective second width, the first width of the at least one insert being greater than the second width of the slot and there being a smooth transition between the respective first and second widths.

18 Claims, 4 Drawing Sheets

(51) Int. Cl.

| | |
|---|---|
| ***F01D 17/16*** | (2006.01) |
| ***F04D 27/00*** | (2006.01) |
| ***F04D 19/00*** | (2006.01) |
| ***F04D 29/54*** | (2006.01) |
| ***F04D 29/56*** | (2006.01) |

(56) References Cited

U.S. PATENT DOCUMENTS

| | | | | |
|---|---|---|---|---|
| 5,062,767 | A * | 11/1991 | Worley | F01D 9/042 415/190 |
| 6,129,512 | A * | 10/2000 | Agram | F01D 17/162 415/160 |
| 7,802,963 | B2 * | 9/2010 | Holland | F01D 9/042 415/148 |
| 9,605,549 | B2 * | 3/2017 | Humhauser | F01D 11/003 |
| 2014/0044526 | A1 | 2/2014 | Humhauser | |

OTHER PUBLICATIONS

Mar. 2, 2016 Search Report issued in European Patent Application No. 15188503.

* cited by examiner

MOUNTING ARRANGEMENT FOR VARIABLE STATOR VANE

FIELD OF THE INVENTION

The present invention relates to a mounting arrangement for mounting a variable stator vane within a gas turbine engine.

BACKGROUND OF THE INVENTION

Variable stator vanes (VSVs) are typically used in gas turbine engines to allow adjustment of the direction of airflow onto the rotating aerofoil blades e.g. in the compressor sections of the engine.

The VSVs are held radially between an outer casing of the engine and an inner shroud, the inner shroud typically being formed of metal such as aluminium or steel, or a composite material such as carbon reinforced plastics material. The shroud is normally formed as two semi-circular ring segments which are joined by fasteners.

Each VSV has a spindle at its root end and the spindles are held and pivotable (about a radial axis) within bores which are machined into the inner shroud. Each bore is lined with a polymeric bushing (e.g. formed of Vespel™) to reduce wear on the spindles and shroud and to allow for thermal expansion.

The radially innermost surface of the shroud is typically coated with an abradable liner which is abraded by rotation of a labyrinth seal located on the compressor drum to form a seal between the shroud and compressor drum.

As discussed above, known shrouds are provided with machined/drilled bores fitted with bushings. The machining of the bores and subsequent fitting of the bushing is time consuming and costly.

It is an aim of the present invention to provide a mounting arrangement for mounting a variable stator vane within a gas turbine engine which reduces manufacturing time and costs.

SUMMARY OF THE INVENTION

In a first aspect, the present invention provides a mounting arrangement for mounting a variable stator vane within a gas turbine engine, said mounting arrangement comprising an inner shroud having a radially- and circumferentially-extending slot and at least one insert which, in use, is retained within said slot and has at least one bore for receiving a spindle portion of the variable stator vane, wherein:

the at least one insert is formed of a plastics material.

By forming the at least one insert of a plastics material, a simple moulding operation, e.g. injection moulding, can be used to form the insert with the bore which obviates the need for drilling and thus reduces manufacturing time/costs.

In a second aspect, the present invention provides a mounting arrangement for mounting a variable stator vane within a gas turbine engine, said mounting arrangement comprising an inner shroud having a radially- and circumferentially-extending slot and at least one insert which, in use, is retained within said slot and has at least one bore for receiving a spindle portion of the variable stator vane, wherein:

the slot and the at least one insert each have a respective axial cross section with a respective first width (axial dimension) which is greater than and radially inwards from a respective second width, the first width of the at least one insert being greater than the second width of the slot and there being a smooth transition between the respective first and second widths.

The insert(s) can be securely retained within the slot because the first (greater/maximum) radially inwards width of the insert(s) cannot move past the second, radially outwards width of the slot. The smooth transition between the first and second widths on the insets) and slot facilitates manufacturing of the insert(s) and shroud and thus reduces manufacturing costs and time.

Optional features of the invention will now be set out. These are applicable singly or in any combination with any aspect of the invention.

In some embodiments, the at least one insert is formed of reinforced plastics material.

In some embodiments, the inner shroud may be formed of reinforced plastics material. This allows flexing of the inner shroud should adjacent variable stator vanes be subjected to opposing axial forces in cases of surge or local turbulence.

The reinforced plastics material (forming the insert(s)/inner shroud) may be a fibre-reinforced plastics material e.g. a carbon/graphite-fibre reinforced plastics material. The reinforcing fibres may be in the form of a fabric or a unidirectional sheet. The reinforcing fibres may be axially and/or circumferentially aligned. The plastics material may comprise a polyimide, a polyamide-imide, polyether imide, polybenzimidazole, a bismaleimide, an epoxy resin or blends thereof. The reinforced plastics material may be Vespel™, Superimide® (Maverick) or a similar high-strength, high-temperature wear-resistant material.

In some embodiments, the inner shroud comprises axially- and circumferentially-extending frame portions projecting from adjacent the radially outermost portion of the slot for increasing the stiffness of the inner shroud. The inner shroud and frame portions may be a unitary element and the opposing frame portions may be formed of the reinforced plastics material. The fibres in each of the opposing frame portions may be axially and/or circumferentially aligned in order to increase strength and stiffness of the opposing frame portions. In some embodiments, the inner shroud is annular/a ring or is part of a segment of an annulus (e.g. a half-ring). If it is part of a segment of an annulus, it further comprises at least one fastener for fastening to at least one further inner shroud segment for forming an annulus.

In some embodiments, the axial cross-section of the slot and at least one insert has substantially the same shape (although the first and second widths of the insert will be slightly less than the first and second widths of the slot).

In some embodiments, the slot and the at least one insert each have a substantially trapezoidal axial cross-section. This allows the/each insert to be securely retained within the slot in a dovetail arrangement.

In some embodiments, the mounting arrangement comprises a plurality of inserts each with at least one bore, each of the plurality of inserts for retention in the slot in abutment with an adjacent insert.

In some embodiments, the/each insert is a unitary (one-piece) insert.

In some embodiments, the/each insert is completely contained within the slot e.g. with its radially outer surface flush with the radially outermost portion of the slot and/or the frame portions.

In some embodiments, the or each insert has a plurality of bore, e.g. two bores, on its radially outer surface.

In some embodiments, the radially innermost surface of the inner shroud is provided with a liner of abradable material.

In a third aspect, the present invention provides an axial compressor having a mounting arrangement according to the first and/or second aspect of the present invention and a variable stator vane mounted in the at least one bore on the at least one insert.

In some embodiments, the mounting arrangement comprises a plurality of inserts each with at least one bore and the axial compressor comprises a plurality of variable stator vanes each mounted in a respective bore.

In a fourth aspect, the present invention provides a gas turbine engine comprising a mounting arrangement according to the first or second aspect of the present invention or an axial compressor according to the third aspect of the present invention.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
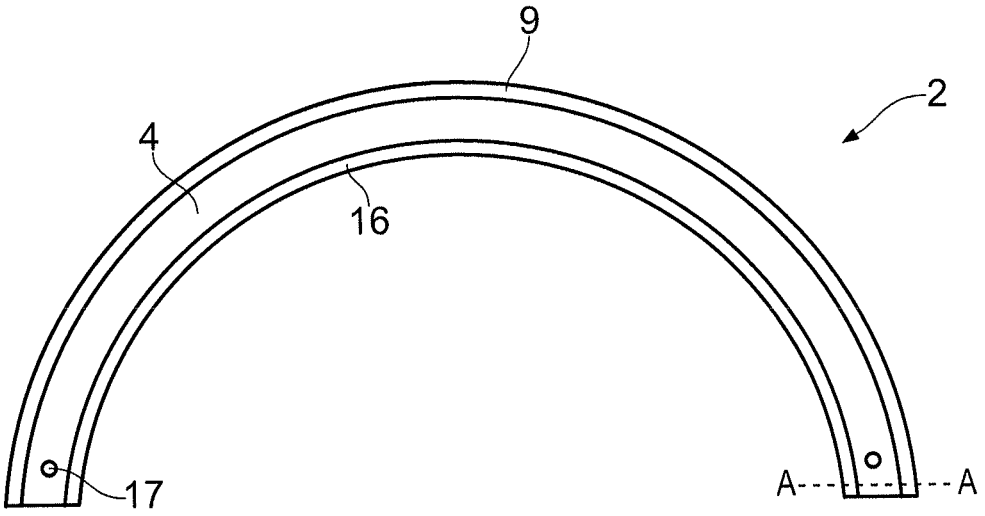
FIG. 1 shows a perspective view of a first embodiment of the inner shroud.
Figure 2:
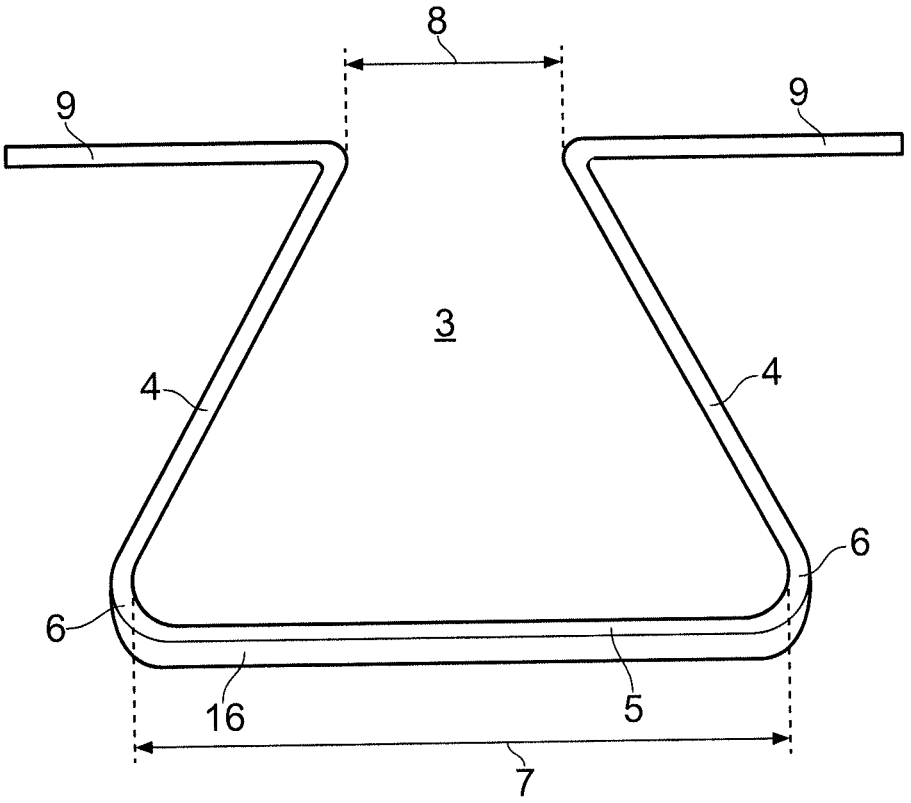
FIG. 2 shows an axial cross-section through the inner shroud of FIG. 1 along line A-A.

FIGS. 1 and 2 show a first embodiment of an inner shroud 2 for use in a mounting arrangement 1 for mounting a variable stator vane within a gas turbine engine.

The inner shroud 2 is formed as a half ring and has a slot 3 which extends radially and circumferentially. Inner shroud 2 has fasteners 17 at its ends to connect it to a further inner shroud to form an annulus.

The slot 3 is defined by opposing circumferentially- and radially-extending side walls 4 and an axially- and circumferentially-extending base wall 5. The edges 6 where the base wall 5 and side walls 4 meet may be rounded as shown in FIG. 2.

The slot 3 has a width (in an axial direction) that decreases in a radially outwards direction from a first slot width 7 to a second slot width 8 i.e. the spacing between the opposing side walls 4 decreases in a radially outwards direction. The width/spacing decreases constantly in the radially outwards direction i.e. the gradient of the opposing side walls 4 is constant and there is a smooth transition from the first slot width 7 to the second slot width 8. As a result, the slot 3 has a substantially trapezoidal axial cross-sectional profile with the maximum axial dimension/first slot width (corresponding to the base wall 5) radially innermost.

The inner shroud 2 is formed of reinforced plastics material which allows flexing of the inner shroud in cases of surge or local turbulence.

The reinforced plastics material is a carbon/graphite-fibre reinforced plastics material such as Vesper™, Superimide® (Maverick) or a similar high-strength, high-temperature wear-resistant material.

The radially inner surface of the base wall 5 of the slot has an abradable liner 16.

The inner shroud 2 further comprises axially- and circumferentially-extending frame portions 9 projecting from and integral with the radially outer ends of the opposing side walls 4.

FIGS. 3, 4*a*, 4*b*, 5*a* and 5*b* show a first and second embodiment of an insert 10 for retention within the slot 3 of the inner shroud 2.

Figure 3:
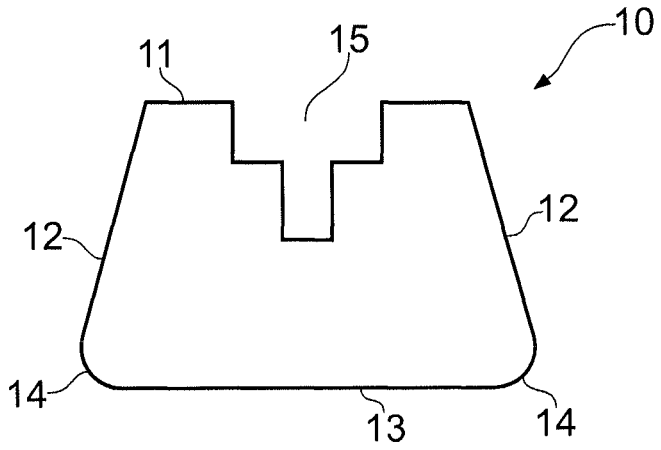
FIG. 3 shows an axial cross-section through a first and second embodiment of an insert.
Figure 4A:
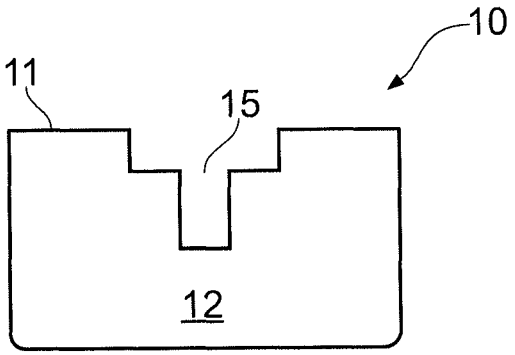
FIG. 4*a* shows a radial cross-section through the first embodiment of the insert.
Figure 4B:
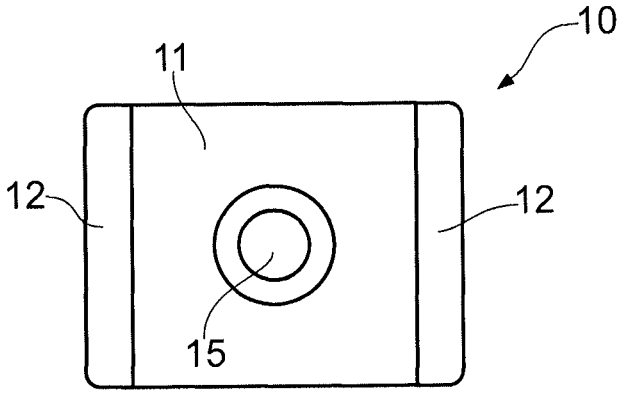
FIG. 4*b* shows a top view of the insert of FIG. 4*a;*
Figure 5A:
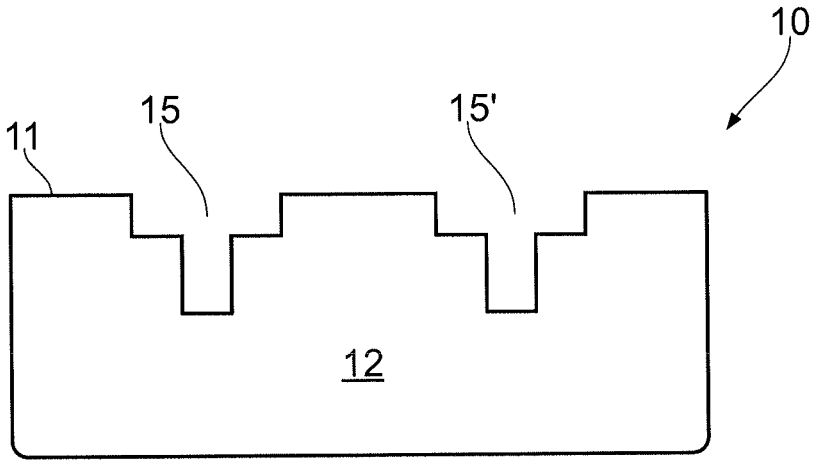
FIG. 5*a* shows a radial cross-section through the second embodiment of the insert.
Figure 5B:
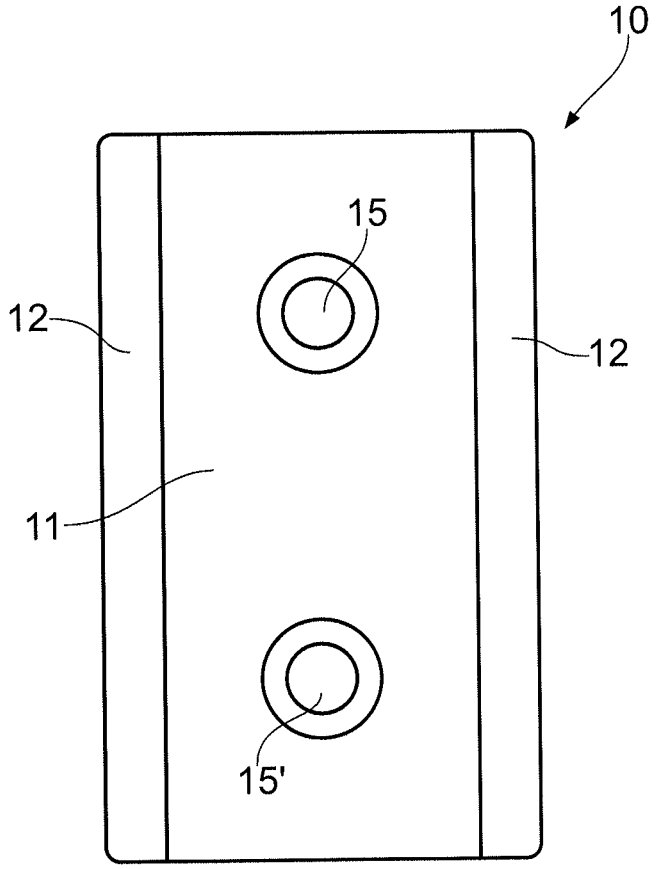
FIG. 5*b* shows a top view of the insert of FIG. 5*a*.

The inserts 10 are shaped as a truncated triangular prism (i.e. with a substantially trapezoidal axial cross-sectional shape as shown in FIG. 3) with the truncated portion forming the radially outer surface 11. The inserts have opposing (radially- and circumferentially-extending) side walls 12 spaced at the radially outer end by the radially outer surface 11 and spaced at the radially inner end by a base surface 13. The (circumferentially-extending) edges 14 joining the side walls 12 and the base surface 13 may be rounded.

The radially outer surface has at least one bore 15 for receiving a spindle portion of a variable stator vane. The second embodiment of the insert shown in FIGS. 5*a* and 5*b* has two, circumferentially-spaced bores 15, 15' on the radially outer surface 11.

The inserts 10 are formed of a reinforced plastics material which allows a simple moulding operation, e.g. injection moulding, to be used to form the inserts with the bores which obviates the need for drilling and thus reduces manufacturing time/costs.

The reinforced plastics material is a carbon/graphite-fibre reinforced plastics material such as Vespel™, Superimide® (Maverick) or a similar high-strength, high-temperature wear-resistant material.

It will be appreciated that various other plastics and non-plastics materials have similar strength, temperature and wear properties and may be suitable for forming the inserts. Other manufacturing methods may be applicable to such materials.

Figure 6:
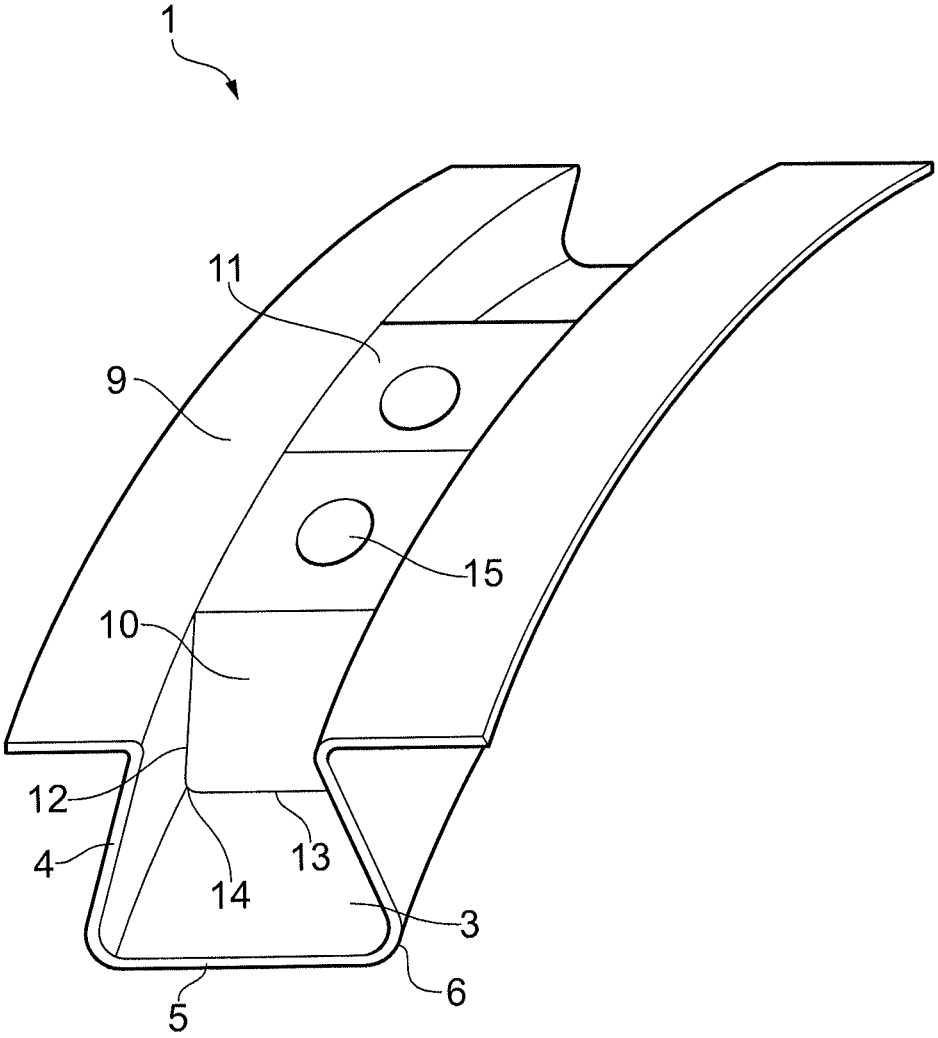
FIG. 6 shows the inserts of FIGS. 4*a*/4*b* retained within the inner shroud of FIGS. 1 and 2.

When inserts 10 are retained (abutting one another) in the slot 3 in the inner shroud 2 (as shown in FIG. 6), the base surface 13 is proximal the base wall 5 of the slot. The first width in an axial direction of the insert (which corresponds to the axial dimension of the base surface 13) is greater than the minimum spacing (second slot width) between the opposing side walls 4 of the slot 3 such that the insert 10 is retained within the slot 3.

The gradient of the opposing side walls 12 of the insert 10 may substantially match the gradient of the opposing side walls 4 of the slot.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A mounting arrangement for mounting a variable stator vane within a gas turbine engine, said mounting arrangement comprising an inner shroud having a radially- and circumferentially-extending slot and at least one insert which, in use, is retained within said slot and has at least one bore for receiving a spindle portion of the variable stator vane, wherein:

the slot and the at least one insert each have a respective axial cross section with a respective first width (axial dimension) which is greater than and radially inwards from a respective second width, the first width of the at least one insert being greater than the second width of the slot.

2. A mounting arrangement according to claim 1 wherein: there is a smooth transition between the respective first and second widths.

3. A mounting arrangement according to claim 1 wherein the inner shroud comprises axially- and circumferentially-extending frame portions projecting from adjacent the radially outermost portion of the slot.

4. A mounting arrangement according to claim 1 wherein the at least one insert is formed of a plastics material.

5. A mounting arrangement according to claim 1 wherein the or each insert has a plurality of bores, each for receiving a respective variable stator vane.

6. An axial compressor having a mounting arrangement according to claim 1 with a variable stator vane mounted in the at least one bore on the at least one insert.

7. A gas turbine engine comprising an axial compressor according to claim 6.

8. A gas turbine engine comprising a mounting arrangement according to claim 1.

9. A mounting arrangement according to claim 1 wherein the at least one insert is formed of a plastics material.

10. A mounting arrangement for mounting a variable stator vane within a gas turbine engine, said mounting arrangement comprising an inner shroud having a radially- and circumferentially-extending slot and at least one insert which, in use, is retained within said slot and has at least one bore for receiving a spindle portion of the variable stator vane, wherein:

the slot and the at least one insert each have a respective axial cross section with a respective first width (axial dimension) which is greater than and radially inwards from a respective second width, the first width of the at least one insert being greater than the second width of the slot and there being a smooth transition between the respective first and second widths.

11. A mounting arrangement according to claim 10 wherein the at least one insert is formed of a plastics material.

12. A mounting arrangement according to claim 10 wherein the inner shroud comprises axially- and circumferentially-extending frame portions projecting from adjacent the radially outermost portion of the slot.

13. A mounting arrangement according to claim 10 wherein the slot and the at least one insert each have a substantially trapezoidal axial cross section.

14. A mounting arrangement according to claim 10 wherein the or each insert has a plurality of bores, each for receiving a respective variable stator vane.

15. An axial compressor having a mounting arrangement according to claim 10 with a variable stator vane mounted in the at least one bore on the at least one insert.

16. A gas turbine engine comprising an axial compressor according to claim 15.

17. A gas turbine engine comprising a mounting arrangement according to claim 10.

18. A mounting arrangement for mounting a variable stator vane within a gas turbine engine, said mounting arrangement comprising an inner shroud having a radially- and circumferentially-extending slot and at least one insert which, in use, is retained within said slot and has at least one bore for receiving a spindle portion of the variable stator vane, wherein:

the slot and the at least one insert each have a respective axial cross section with a respective first width (axial dimension) which is radially inwards from a respective second width, and there being a smooth transition between the respective first and second widths.

* * * * *